United States Patent [19]

Herman, III

[11] 4,242,915

[45] Jan. 6, 1981

[54] EXTENSOMETER ANCHOR

[75] Inventor: Charles Herman, III, Pompano Beach, Fla.

[73] Assignee: The United States of America as represented by the Secretary of the Interior, Washington, D.C.

[21] Appl. No.: 66,999

[22] Filed: Aug. 16, 1979

[51] Int. Cl.[3] ..... G01N 33/24

[52] U.S. Cl. ..... 73/784; 403/203

[58] Field of Search ..... 73/784; 85/8.8, 66, 85/63, 80, 81; 403/365, 366, 367, 203, 406, DIG. 7

[56] References Cited

U.S. PATENT DOCUMENTS

| | | | |
|---|---|---|---|
| 2,690,346 | 9/1954 | Miller | 403/365 X |
| 2,712,952 | 7/1955 | Lundgren | 403/365 |
| 3,535,750 | 10/1970 | Metz | 85/66 X |
| 4,159,641 | 7/1979 | Hawkes | 73/784 X |

*Primary Examiner*—Jerry W. Myracle

*Attorney, Agent, or Firm*—Thomas Zack; Donald A. Gardiner; Gersten Sadowsky

[57] ABSTRACT

An extensometer anchor for use in a mine borehole. The anchor has an anchor body that, when in an operative mode, is placed in the borehole. Extending at least partially around the outer surface of the body are one or more grooves whose major plane is generally perpendicular to the length of the borehole. Seated within each groove is a compressible resilient anchor member, like a ring, which remains loaded by a retaining device, such as a cotter pin, extending through it. Upon being pulled from outside of the borehole, the retaining device unloads the compressed anchor which then moves to expand outwardly in the borehole and firmly anchor the anchor body and attached extensometer within the mine borehole.

7 Claims, 4 Drawing Figures

EXTENSOMETER ANCHOR

BACKGROUND OF THE INVENTION

1. Field of the Invention

This invention is an anchoring device especially designed to be used with an extensometer.

2. Description of the Prior Art

The concept of using retaining rings that are placed in grooves of a member to be retained so that the rings expand outwardly to anchor the member is known. The United States patent to W. G. Tilton (U.S. Pat. No. 502,686) shows this arrangement wherein there are grooves in one member and also grooves in a shaft coupling that is retained thereon. Normally the retaining rings are compressed (page 1, line 42) or loaded—presumably by hand, pliers, etc.— and then held by the outer coupling until the sets of grooves of the coupling and member are aligned to coincide as one is moved relative to the other. Then the compressed loaded rings spring outwardly to anchor the members together.

Another reference (U.S. Pat. No. 929,979 to H. W. Pleister) discloses expanders 17 mounted in a slot 12 and a split ring 22 used to hold the expanders together in handling and shipping. Still other reference (U.S. Pat. No. 2,388,841 to D. W. Goodwin) discloses a spring shoe 60 with a set screw 71 to vary the friction (page 2, lines 62–73). A split ring with holes 23 used to receive tools to move the ring is disclosed in U.S. Pat. No. 2,491,306 to R. Feitl. Two U.S. patents—U.S. Pat. Nos. 3,535,750 and 3,698,278 to J. R. Metz and W. H. Trembley, respectively—disclose the idea of an outwardly biased locking member which is actuated by a pull device.

Perhaps the closest prior art to applicant's invention is the U.S. Pat. No. 2,712,952 to K. I. Lundgren. Therein a resilient ring 1 has holes at lugs 2 to receive the bolts 3. As the nuts 5 on the bolts are tightened the ring becomes fixed in the grooves 8. The FIG. 6–8 embodiment uses recesses 18 in the ring to lock it in cooperation with the bolt 19 (column 2, lines 21 et seq.)

Although the prior art discloses many of the essential features of the present invention, it fails to suggest or disclose the totality thereof or most of them used for the same or a similar purpose. None discloses an anchor body which is locked in a borehole by a preloaded resilient member placed in a groove of the anchor body which member has provision to hold the member in a loaded position by a pullable retaining member extending outside the borehole and unload the member by actuating the retaining member. None discloses a similar system useable with a extensometer anchor that is placed in a mine borehole and simply actuated by pulling a member located outside of the borehole.

SUMMARY OF THE INVENTION

My invention relates to an anchoring device which is actuated by pulling a retaining member. The retaining member is normally mounted so that it holds a resilient loaded member in a compressed position within the groove of an anchor body which body is to be anchored within a borehole. A connecting rod allows the anchor or anchors, as the case may be, to be classified as a single or multipoint extensometer.

The primary object of this invention is a simple, inexpensive, easily actuated borehole anchor.

More particularly, it is to provide a mining borehole anchor with these characteristics actuated by pulling a member outside of the borehole, and wherein the anchor is attached via a connecting rod or rods to an extensometer.

DESCRIPTION OF THE PREFERRED EMBODIMENT

Figure 1:
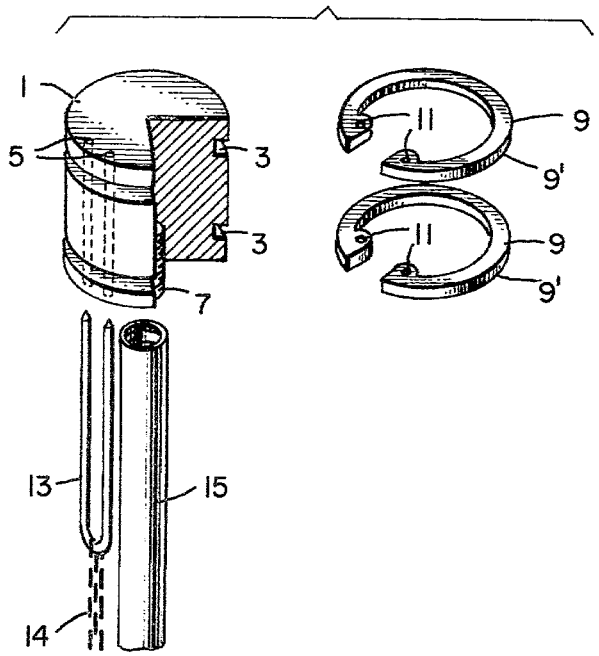
FIG. 1 is a partial cross-sectional exploded view of the preferred embodiment of the invention.

FIG. 1 is an exploded partial cross-sectional view of the preferred embodiment of my invention. Essentially it consists of the solid cylindrically shaped metal or polymer anchor body 1 having two generally parallel and identical transverse grooves 3 extending around its outer surface. Perpendicular to these grooves are two paralled holes that run in the longitudinal direction and intersect therewith and extend from the bottom to the top of the anchor body. Depending on what it is mounted, the anchor body has some type of mount attaching provision such as the lower center hole shown with its threaded set screw connection 7.

To anchor the anchor body in a mine borehole two identical resilient C-shaped retaining rings 9 may be used. Each of these rings is generally C shaped and therefore, opened at one sector which has two enlarged nubs. This construction allows the ring to flex in a plane cutting its major extent. The rings are sized and shaped to fit, when compressed, into the body's grooves. Near each of the enlarged opened ends or nubs of each ring is an aperture 11 extending through its nub and of about the same diameter as the holes 5. Complementary sized in diameter is an elongated U-shaped cotter pin 13 which fits into the holes 5 from the bottom of the anchor's body in its longitudinal direction and extends upwardly so that its two legs pass through each of the grooves 3 and its bight portion faces towards the open end of the mine borehole.

When in an operative mode the cotter pin fits into the hole 5 and extends through the two grooves 3. It also extends through the two holes 11 of each ring, which ring is seated in each of its respective grooves 3. In order to get the rings into the respective grooves, the lower ring is compressed so that the normally spaced apart holes 11 are aligned with holes 5. Next, the upper ring is compressed in a similar manner and properly aligned and seated in the upper groove. Then the cotter pin is pushed further to cause its legs to extend through the aligned hole 11 of the compressed upper ring. This procedure leads the two rings so that they will unload to expand outwardly in the borehole to bind firmly therein when the pin is pulled downwardly. A chain 14 which extends from outside the borehole can be attached to the bight of the cotter pin to pull the pin downwardly and out of the holes 5 and 11 to set the anchor. Support rod 15 with its internal threads mounts the anchor body at its threads 7. Support rod 15 provides the axial thrust to hold the anchor in place while cotter pin 13 is being pulled.

Figure 2:
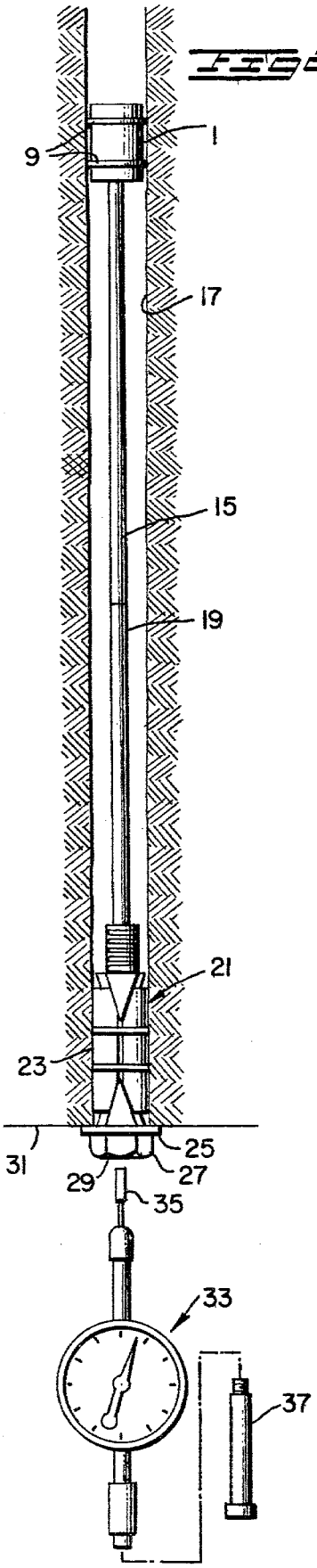
FIG. 2 shows how the FIG. 1 embodiment would typically be employed in a single extensometer set up within a mine borehole.

FIG. 2 shows how the FIG. 1 embodiment would typically be employed as a single anchor in a mine borehole 17. The transverse diameter of the anchor's body is selected so that it is slightly less than than the diameter of the borehole that has been previously drilled. Routinely this would be 1, 1¼ or 1⅜ inches. After the cotter pin is pulled to allow the loaded rings to unload and expand outwardly against the borehole wall, as shown, the body is anchored. Downwardly depending from the anchor body is the mounted connecting rod 15. If the anchor is sufficiently deep in the borehole a second connecting rod 19 connected by a set screw connection to the first rod may be used. Connected to this second rod is a roof level anchor 21 having a shell section 23, a washer 25, a bolt head 27, and a reference surface 29. The washer, bolt head and its reference surface, all are located outside of the borehole at the mine's roof 31.

The roof level anchor, which may be used with my invention, is a double shell expansion borehole anchor set in place by rotating the bolt passing through the device. The washer prevents the anchor bolt head from entering the borehole. The upper end of the roof anchor has a vertical internally threaded hole (not shown) which allows the externally threaded free end of rod 19 to be connected. Normally the reference surface 29 on the bottom of the bolt head is ½ to 1 inch below the lower end of the roof level anchor.

Below the reference is a dial gage readout unit 33 having a resolution of 0.001 inch and a plunger 35 with a possible 5 inch stroke. This type of plunger mechanism does not return to a zero position after a reading has been made. Readings are taken by pulling out the plunger, positioning it in the hole in the lower anchor against the end of the connecting rods, and then pushing upward on the gage to bring it into contact with the end of the roof level anchor bolt. In this way the gage readings correspond to the distance in inches between the rod end and the anchor reference surface. Repeated recorded readings when compared after a period of time tell by their difference the roof movement between the upper and lower anchors. The gage can be removed from the roof level anchor to read the dial gage, and readings can be taken in up to 10 feet of headroom from floor level using a dial gage extension tube 37.

The single point C-anchor 1 illustrated in FIGS. 1–2 has been used to make routine on-site measurements of roof bed movements in room and pillar mines. The anchor body 1 may be made of a plastic cylinder and the rods 15 and 19 may be made of aluminum for rust resistance and light weight. The FIG. 3–4 multipoint embodiment shares many of the same components with the FIG. 1–2 embodiment. For ease in understanding common components in FIGS. 3–4 have been designed with the same numbers primed.

Figure 3:
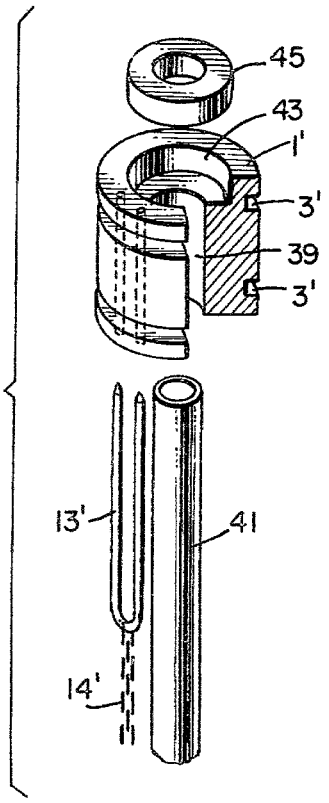
FIG. 3 is a slight modification to the anchor shown in FIG. 1 for use with a multipoint extensometer.
Figure 4:
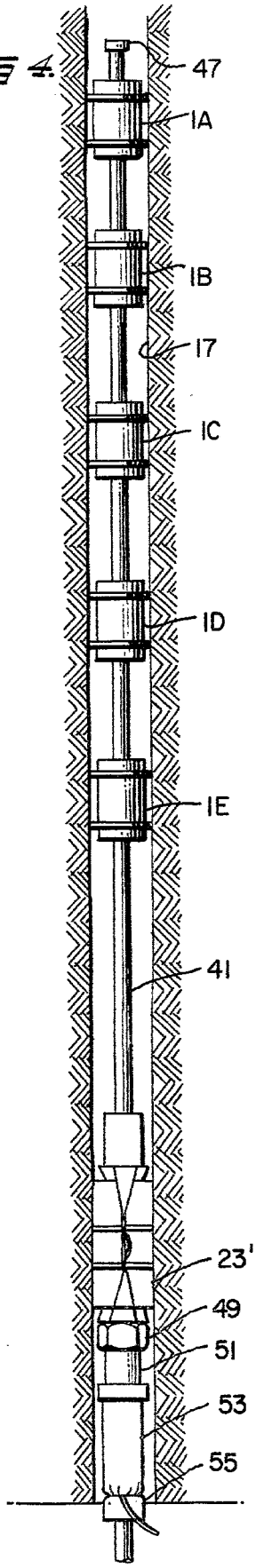
FIG. 4 depicts how the FIG. 3 embodiment could be set up in a mine borehole.

The anchor body 1' of FIG. 3 is basically the same as FIG. 1 excepting for the way it provides for its mount to a magnets and a support rod. It has two parallel identical grooves 3', two vertical parallel holes 5', two retaining rings 9', and a cotter pin 13'. Extending completely through the vertical extent of the anchor body is a hole 39 adapted to allow the guide tube 41 to slide through. At the top portion of the holes is the enlarged recessed portion 43 which can receive the seated ring magnet 45 and allow the tube to pass through it. When several anchors are used, five in the example depicted, the multipoint extensometer of FIG. 4 can be achieved. Each of the five anchors (1A to 1E) are constructed as is the anchor of FIG. 3. The uppermost hollow aluminum guide tubes 41 has a plastic end cap 47 to protect it from dirt and moisture. As before, to anchor the system in the borehole 17 a special cotter pin is pulled via a chain to cause the retaining rings for each anchor to spring out to engage the sides of the borehole. A setting tool (not shown) consisting of a rigid tube provides the axial thrust to hole the anchors in place while the cotter pin 13 is being pulled. The setting tool is removed after the anchor is set. Normally several separate guide tubes 41 are joined together in tandem to form the central guide for the flexible probe 53. Nearer to where the extensometer exists from the borehole is the roof level anchor 23', then, further down, the nut 49 having an internal thread 51, the flexible probe 53, and at, the borehole's beginning, the probe insertion tool 55. The reading's taken with the probe relate to the positions of the ring magnets 45 of each anchor. These magnets would encircle their respective tubes 41 along the length of the borehole and, in FIG. 4, would be at a five different spaced positions. It is the variations in these readings, recorded at different times, which allow the state of the roof mining operation for this multipoint extensometer to be determined. A remote digital readout unit (not shown) connected to the probe's wires can record positional changes to 0.001 of an inch.

It should be clear that many modifications can be made to the disclosed features and yet still stay within the scope and extent of my invention. For example, the number of anchor units useable with the FIG. 4 multipoint extensometer could be increased or decreased depending on the needs of the user, the materials used to construct the various parts could be varied, the shape of the ring retaining cotter pin could change, the number of retaining rings could vary, and the way the anchor body is mounted to the rod or tube could be different. None of these possible modifications or others should be used to limit the invention which is to be measured only by the claims which follow.

I claim:

1. An anchoring device for use with an extensometer in an underground mine borehole comprising:

an anchor body shaped to longitudinally fit into the mine borehole and having at least one groove on its outer surface extending substantially around the anchor body;

a resilient anchoring member for use in each of said at least one grooves, said member being compressible into a loaded position while mounted in said grooves and having means for attaching a retaining member thereto; and a retaining member extending towards the opening of the mine borehole and engageable with said means for attaching to normally maintain the anchoring member in a loaded compressed state while in said groove, said retaining member, when removed by pulling from outside the borehole, allowing the anchoring member to expand outwardly to engage the mine borehole and anchor the anchor body therein.

2. The anchoring device of claim 1 wherein:

said anchor body has an opening to mount a vertical support rod for the device whereby the anchor can be inserted into a borehole while mounted thereon.

3. The anchoring device of claim 1 wherein:

said at least one groove comprises two generally parallel grooves on the anchor body's exterior surface; and said resilient anchoring member adapted for use with each groove is a C-shaped retaining ring.

4. The device of claim 3 wherein:

said means for attaching a retaining member to each of the anchoring members comprises two openings extending therethrough one of which is located near each of the opened ends of the C.

5. The device of claim 4 wherein:

the retaining member is a U-shaped member extending through the two openings of the anchoring member such that its bight section faces towards the borehole opening.

6. The anchoring device of claim 2 wherein said anchor body opening has a series of threads adapted to receive complementary shaped threads of the support rod.

7. The anchoring device of claim 2 wherein said anchor body opening extends through the longitudinal extent of the anchor body with the upper portion of the opening being larger to thereby form a recessed portion adaptable to receive a magnet.

* * * * *